US008923732B2

(12) United States Patent
Harada et al.

(10) Patent No.: US 8,923,732 B2
(45) Date of Patent: Dec. 30, 2014

(54) CHARGING MEMBER, MANUFACTURING METHOD THEREFOR, AND ELECTROPHOTOGRAPHIC APPARATUS

(75) Inventors: Masaaki Harada, Yokohama (JP); Hiroaki Watanabe, Odawara (JP); Keiji Nose, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 13/695,781

(22) PCT Filed: Jul. 2, 2012

(86) PCT No.: PCT/JP2012/004275
§ 371 (c)(1),
(2), (4) Date: Nov. 1, 2012

(87) PCT Pub. No.: WO2013/005411
PCT Pub. Date: Jan. 10, 2013

(65) Prior Publication Data
US 2014/0219681 A1 Aug. 7, 2014

(30) Foreign Application Priority Data
Jul. 6, 2011 (JP) ..... 2011-150160

(51) Int. Cl.
*G03G 15/02* (2006.01)

(52) U.S. Cl.
CPC ..... *G03G 15/0233* (2013.01)
USPC ..... 399/176; 399/115

(58) Field of Classification Search
USPC ..... 399/115, 174, 176
See application file for complete search history.

(56) References Cited

U.S. PATENT DOCUMENTS

| | | | | |
|---|---|---|---|---|
| 6,040,104 | A * | 3/2000 | Nakamura et al. | 430/109.4 |
| 6,287,246 | B1 * | 9/2001 | Yoshii et al. | 492/59 |
| 6,697,587 | B2 * | 2/2004 | Harada | 399/111 |
| 7,486,911 | B2 * | 2/2009 | Harada | 399/115 |
| 2011/0176833 | A1 | 7/2011 | Harada et al. | |
| 2012/0045250 | A1 * | 2/2012 | Harada et al. | 399/168 |
| 2012/0076539 | A1 | 3/2012 | Sato et al. | |
| 2012/0082852 | A1 | 4/2012 | Nose et al. | |
| 2012/0141161 | A1 | 6/2012 | Watanabe et al. | |
| 2012/0177408 | A1 | 7/2012 | Watanabe et al. | |
| 2012/0224887 | A1 | 9/2012 | Harada et al. | |
| 2013/0039677 | A1 | 2/2013 | Nose et al. | |

FOREIGN PATENT DOCUMENTS

| | | | |
|---|---|---|---|
| JP | 9-160355 | A | 6/1997 |
| JP | 2005-316106 | A | 11/2005 |
| JP | 2007-286498 | A | 11/2007 |
| JP | 2010-66481 | A | 3/2010 |
| JP | 2010-256617 | A | 11/2010 |

OTHER PUBLICATIONS

International Preliminary Report on Patentability, International Application No. PCT/JP2012/004275, Mailing Date Jan. 16, 2014.

* cited by examiner

*Primary Examiner* — Clayton E Laballe
*Assistant Examiner* — Warren K Fenwick
(74) *Attorney, Agent, or Firm* — Fitzpatrick, Cella, Harper and Scinto

(57) ABSTRACT

Provided is a charging member capable of suppressing occurrence of compression set while having flexibility enough to ensure a nip with a photosensitive member. The charging member comprises a support and an elastic layer, wherein the elastic layer has an MD-1 hardness of from 55 to 85° at the surface thereof, and has a universal hardness of 2.0 to 20.0 $N/mm^2$ at an indentation depth of 5 μm from the surface thereof.

11 Claims, 2 Drawing Sheets

CHARGING MEMBER, MANUFACTURING METHOD THEREFOR, AND ELECTROPHOTOGRAPHIC APPARATUS

CROSS-REFERENCE TO RELATED APPLICATIONS

This application is a continuation of International Application No. PCT/JP2012/004275, filed Jul. 2, 2012, which claims the benefit of Japanese Patent Application No. 2011-150160, filed Jul. 6, 2011.

BACKGROUND OF THE INVENTION

1. Field of the Invention

The present invention relates to a charging member to be used in an electrophotographic apparatus or the like, a manufacturing method therefor, and an electrophotographic apparatus.

2. Description of the Related Art

A charging member to be used in contact charging of an object to be charged such as an electrophotographic photosensitive member is generally provided with an elastic layer containing a rubber, a thermoplastic elastomer, or the like in order to ensure a uniform nip with the object to be charged and to prevent the object to be charged from being damaged. However, toner or an external additive is liable to adhere to a surface of such elastic layer. Further, when the elastic layer and the photosensitive member abut on each other in a resting state over a long period of time, permanent deformation may occur in the abutment portion of the elastic layer. To cope with such problem, Japanese Patent Application Laid-open No. H09-160355 discloses a charging member including a surface-modified layer formed by subjecting a surface of an elastic layer to irradiation with an energy ray such as a UV ray or an electron beam.

SUMMARY OF THE INVENTION

However, in the charging member as described in Patent Literature 1 above, it was difficult to simultaneously achieve both of ensuring of a uniform nip with the object to be charged and suppression of occurrence of compression set at a portion where the charging member and the photosensitive member abut on each other for a long period of time in some cases.

In view of the foregoing, the present invention is directed to providing a charging member capable of suppressing occurrence of compression set while having flexibility enough to ensure a nip with a photosensitive member, and a manufacturing method therefor.

Further, the present invention is directed to providing an electrophotographic apparatus capable of stably outputting a high-quality electrophotographic image.

According to one aspect of the present invention, there is provided a charging member, comprising: a support; and an elastic layer, wherein the elastic layer has an MD-1 hardness of from 55 to 85° at the surface thereof, and has a universal hardness of 2.0 to 20.0 N/mm$^2$ at an indentation depth of 5 μm from the surface thereof.

According to another aspect of the present invention, there is provided a charging member, comprising: a support; and an elastic layer, wherein the elastic layer is formed by vulcanizing and molding an unvulcanized rubber composition comprising the following rubbers (A) and (B), and then irradiating a surface of a vulcanized and molded product with an electron beam:

(A) a butadiene rubber or a styrene-butadiene rubber; and (B) a liquid rubber having a butadiene skeleton and containing per molecule three or more functional groups selected from an acrylic group, a methacryloyl group, and a maleic acid group.

According to further aspect of the present invention, there is provided a manufacturing method for a charging member comprising a support and an elastic layer, wherein the elastic layer has an MD-1 hardness of from 55 to 85° at the surface thereof, and has a universal hardness of 2.0 to 20.0 N/mm$^2$ at an indentation depth of 5 μm from the surface thereof, said elastic layer being a mono-layer, the method comprising the steps of:

(1) forming, on the support, a rubber layer by vulcanizing a layer of an unvulcanized rubber composition comprising the rubbers (A) and (B); and (2) irradiating a surface of the rubber layer resulting from the step (1) with an electron beam.

According to still further aspect of the present invention, there is provided an electrophotographic apparatus, comprising: the above-described charging member; and an electrophotographic photosensitive member placed to be charged by the charging member.

According to the present invention, there is provided the charging member which hardly causes compression set even when abutting on a photosensitive member over a long period of time while having flexibility enough to ensure a uniform nip with the photosensitive member.

Further, according to the present invention, provided is the electrophotographic apparatus capable of stably providing a high-quality electrophotographic image.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The inventors of the present invention have made extensive studies in view of the objects. As a result, the cross-linking density on the surface side of an elastic layer provided on a support is made higher than the cross-linking density in the inside of the elastic layer, a difference in hardness between the outermost surface and the inside of the elastic layer is increased, and an MD-1 hardness, which represents a hardness of a portion at a predetermined depth from the surface of the elastic layer, is controlled within a range of 55 to 85°.

Meanwhile, a universal hardness at an indentation depth of 5 μm in the surface of the elastic layer, which is a measure of a hardness of a portion in the vicinity of the surface of the elastic layer, is controlled within a range of 2.0 to 20.0 N/mm$^2$.

Both of the ensuring of a uniform nip with a photosensitive member and the suppression of occurrence of compression set can be achieved simultaneously at high levels by increasing a difference in hardness between the vicinity of the surface and the inside of the elastic layer as described above. Such charging member may be formed by: forming a rubber roller by applying onto a support an unvulcanized rubber composition containing a liquid rubber having a functional group exhibiting high reactivity through irradiation with an electron beam, followed by molding and vulcanization; and irradiating a surface of the rubber roller with an electron beam to modify the surface.

The hardness of the entire elastic layer may be reduced by compounding a liquid rubber component in the elastic layer. A liquid rubber to be compounded has a functional group which may cause a cross-linking reaction through irradiation with an electron beam. The surface of the elastic layer is modified by subjecting a surface of a rubber roller formed by molding and vulcanization of an unvulcanized rubber composition containing such functional group to irradiation with an electron beam. Thus, the cross-linking density on the charging member surface side may be increased. With this, a difference in hardness between the inside and the surface side of the elastic layer may be increased.

<Charging Member>

Figure 1:
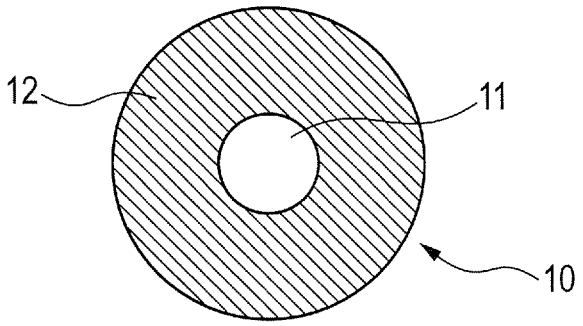
FIG. 1 is a schematic cross-sectional diagram for illustrating a configuration example of a charging roller as a charging member of the present invention.

The charging member of the present invention includes an electro-conductive support, and an elastic layer as a surface layer. FIG. 1 illustrates a schematic configuration example of a charging roller as the charging member of the present invention. A charging roller 10 as the charging member includes a mandrel 11 as a support and an elastic layer 12 formed on the mandrel 11. It should be noted that an example of a charging roller is hereinafter described as an embodiment of the present invention, but the configuration of the present invention is by no means limited to a roller shape.

Figure 2:
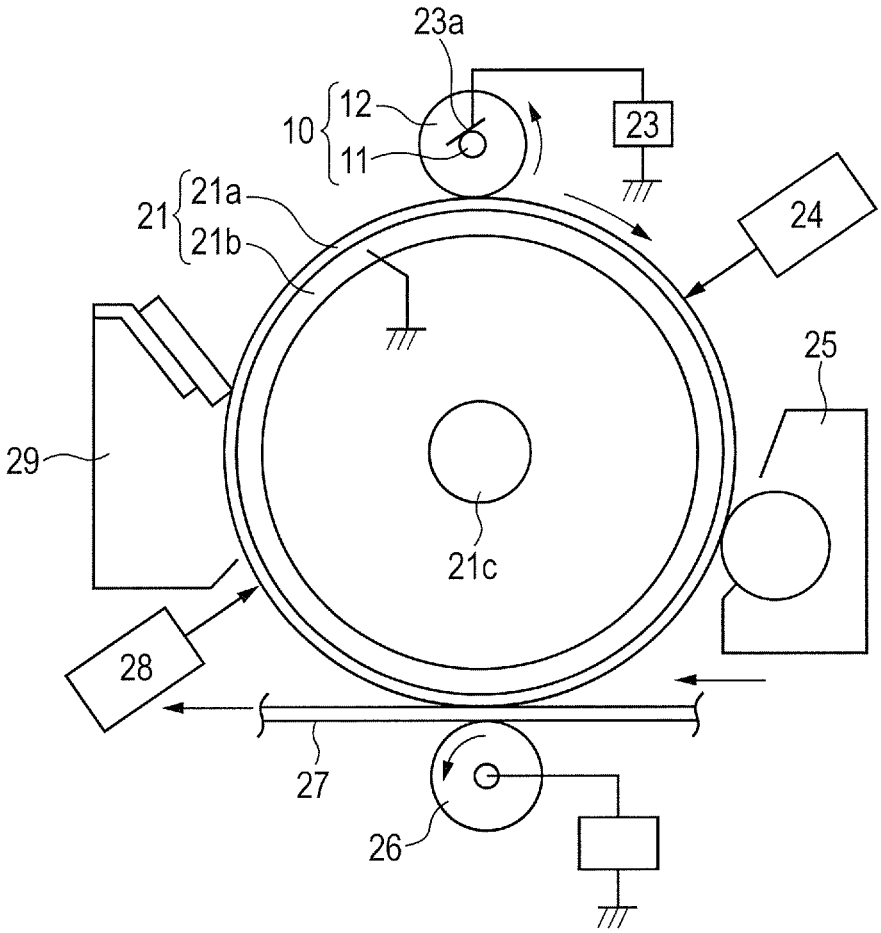
FIG. 2 is a schematic cross-sectional diagram for illustrating a configuration example of an electrophotographic apparatus.

FIG. 2 illustrates a schematic configuration of an electrophotographic apparatus which may use a charging member to be manufactured in the present invention. An electrophotographic photosensitive member as an object to be charged is represented by 21, and the electrophotographic photosensitive member in FIG. 2 is a drum-shaped electrophotographic photosensitive member including as basic configuration layers a support 21*b* having electro-conductivity like aluminum, and a photosensitive layer 21*a* formed on the support 21*b*. The electrophotographic photosensitive member 21 is rotationally driven around a shaft 21*c* at the center at a predetermined peripheral speed in a clockwise direction in the figure.

A charging roller is represented by 10, and the charging member according to the present invention is used. The charging roller 10 is placed so as to be brought into contact with the electrophotographic photosensitive member 21 and charges the electrophotographic photosensitive member with a predetermined polarity and potential (primary charging). The charging roller 10 includes a mandrel 11 and an elastic layer 12 formed on the mandrel 11, is pressed against the electrophotographic photosensitive member 21 by pressing unit (not shown) at both end portions of the mandrel 11, and rotates in accordance with the rotational driving of the electrophotographic photosensitive member 21.

The electrophotographic photosensitive member 21 is subjected to contact charging with a predetermined polarity and potential by applying a predetermined direct current (DC) bias to the mandrel 11 with a rubbing power source 23*a* to be connected to a power source 23. The electrophotographic photosensitive member 21 whose circumferential surface has been charged with the charging roller 10 then receives an exposure of image information of interest (e.g., a laser beam scanning exposure or a slit exposure of a document image) by exposing unit 24. Thus, electrostatic latent images corresponding to the image information of interest are formed on the circumferential surface.

The electrostatic latent images are then sequentially developed into visible images as toner images by developing unit 25. The toner images are then sequentially transferred by transferring unit 26 onto a transfer material 27 taken out of a paper-feeding unit portion (not shown) in synchronization with the rotation of the electrophotographic photosensitive member 21 to be conveyed to a transfer portion between the electrophotographic photosensitive member 21 and the transferring unit 26 at an appropriate timing. The transferring unit 26 in FIG. 2 is a transferring roller as a transferring member, and the toner images are sequentially transferred onto the surface of the transfer material 27 on the electrophotographic photosensitive member 21 side by charging the reverse surface of the transfer material 27 with a polarity opposite to that of the toner.

The transfer material 27 of which the toner images have been transferred on its surface is separated from the electrophotographic photosensitive member 21, conveyed to fixing unit (not shown) where the toner images are fixed, and output as an image-formed product. Alternatively, the transfer material 27 of which the toner images are to be formed on the reverse surface of the transfer material 27 as well is conveyed to reconveying unit (not shown) to the transfer portion of the transfer material 27.

The circumferential surface of the electrophotographic photosensitive member 21 after image transfer receives a pre-exposure by pre-exposing unit 28. Thus, residual charges on the electrophotographic photosensitive member are eliminated (charge elimination). Known unit may be utilized as this pre-exposing unit 28, and for example, an LED chip array, a fuse lamp, a halogen lamp, or a fluorescence lamp may be suitably used.

The circumferential surface of the electrophotographic photosensitive member 21 after charge elimination is cleaned by removing an adhering contaminant such as transfer residual toner by cleaning unit 29, and is subjected to image formation repeatedly.

The charging roller 10 may be driven in accordance with the electrophotographic photosensitive member 21 to be subjected to surface movement driving, may not be allowed to rotate, or may be rotationally driven actively at a predetermined peripheral speed in a forward direction or a reverse direction with respect to the surface movement direction of the electrophotographic photosensitive member 21.

Further, when the electrophotographic apparatus is used as a copying machine, the exposure may be carried out, for example, by reflected light or transmitted light from a document, reading out a document to be converted to signals and scanning a laser beam based on the signals, or driving an LED array.

Examples of the electrophotographic apparatus which may use the charging member to be manufactured in the present invention include a copying machine, a laser beam printer, an LED printer, and an electrophotographic application apparatus such as an electrophotographic plate making system.

The charging member to be manufactured in the present invention may also be used as, in addition to the charging roller, a developing member, a transferring member, a charge eliminating member, or a conveying member such as a paper-feeding roller for feeding the transfer material 27 from the paper-feeding unit portion.

In the charging member of the present invention, the cross-linking density on the surface side of the elastic layer provided on the support is higher than the cross-linking density in the inside of the elastic layer, and the MD-1 hardness in the surface of the elastic layer falls within a range of 55 to 85°, more preferably a range of 65 to 75°. Further, the universal hardness at an indentation depth of 5 μm in the surface of the elastic layer falls within a range of 2.0 to 20.0 N/mm$^2$, more preferably 5.0 to 15.0 N/mm$^2$.

The MD-1 hardness is measured with a micro durometer (trade name: MD-1 capa, type A) manufactured by KOBUNSHI KEIKI CO., LTD. The shape of an indenter used in the measurement is a columnar shape having a height of 0.50 mm and a diameter of 0.16 mm. In addition, the MD-1 hardness to be measured with such apparatus represents a rubber hardness at a depth of about 1 mm at the maximum from the surface of the charging member. Thus, a numerical value for the MD-1 hardness indicates a hardness of a deformation area in the case where the charging member abuts on the photosensitive member, and is a measure representing the status of nip formation between the charging member and the photosensitive member. The control of the MD-1 hardness in the surface of the elastic layer to 55° or more can suppress the occurrence of compression set due to an excessively small hardness of the elastic layer and the occurrence of a failure in an electrophotographic image attributed thereto.

Further, when the hardness of the elastic layer is too high, owing to dimensional accuracy of the charging member and the photosensitive member as an object to be charged, both the members may come into contact with each other in a non-uniform state. Therefore, the control of the MD-1 hardness in the surface of the elastic layer to 85° or less can suppress the occurrence of an image failure due to the occurrence of uneven dirt resulting from an excessively high hardness of the elastic layer.

In addition, a more preferred range of the MD-1 hardness of the elastic layer according to the present invention is 65° to 75°.

A universal hardness is a physical property value determined by pressing an indenter into an object of measurement while applying a load, and is determined by the following expression (1).

$$\text{(Test load)/(Surface area of indenter under test load)} \quad (N/\text{mm}^2) \qquad (1)$$

The universal hardness may be determined by measuring the hardness of the outermost surface of the elastic layer, and the measurement may be carried out, for example, through the use of a measurement apparatus such as an ultra-micro hardness meter (trade name: H-100V manufactured by Fischer).

In the measuring apparatus, the indenter such as a quadrangular pyramid indenter is pressed into the object of measurement while a predetermined relatively small test load is applied, and at a time point when an indentation depth reaches a predetermined value, the surface area of the indenter in contact with the object is determined based on the indentation depth. Thus, the universal hardness is determined from the expression (1). In other words, when the indenter is pressed into the object of measurement under a constant-load measurement condition, a stress at that time with respect to the indentation depth is defined as the universal hardness.

The universal hardness of the elastic layer in the present invention falls within a range of 2.0 to 20.0 N/mm$^2$, more preferably a range of 5.0 to 15.0 N/mm$^2$, as a value at an indentation depth of 5 μm from the surface of the elastic layer.

The control of the universal hardness to 2.0 N/mm$^2$ or more can suppress the occurrence of a set image failure because the cross-linking density in the surface of the elastic layer is sufficiently high and the hardness is high.

Further, the control of the universal hardness to 20.0 N/mm$^2$ or less can prevent the occurrence of an image failure due to the adhesion of toner or an external additive to the surface of the charging member resulting from an excessively high surface hardness of the charging member.

The universal hardness of the elastic layer more preferably falls within a range of 5.0 to 15.0 N/mm$^2$ in order to satisfactorily prevent the occurrence of both of a set image failure and uneven dirt.

It should be noted that, when the indentation depth in the universal hardness is too small, a variation in measured value is liable to occur. Therefore, the indentation depth in the universal hardness in the present invention was set to 5 μm as such a condition that the hardness in the outermost surface of the charging member may be measured with high accuracy.

As described above, the control of the hardnesses of the inside and the surface of the elastic layer within predetermined ranges can suppress the occurrence of a set image failure while preventing an image failure due to dirt.

It should be noted that the set image failure is more improved as the amount of deformation by the abutment of the elastic layer and the photosensitive member becomes smaller, and the amount of deformation at the abutting portion is preferably 20 μm or less. The set image failure also varies depending on conditions for an electrophotographic process. Thus, the amount of set deformation is more preferably 10 μm or less in order that a stable image is obtained without being affected by conditions for the process.

<Support (Mandrel)>

A support (mandrel) has, for example, a columnar shape or a cylindrical shape having a cavity at its central portion, and may be constructed of a known material having rigidity and exhibiting electro-conductivity.

<Elastic Layer>

An elastic layer provided on a support is formed of a base polymer and a compounding agent. The base polymer is not particularly limited as long as it is a material exhibiting rubber elasticity in the actual use temperature range of the charging member after cross-linking (hardening). Further, the base polymer is preferably a material to be hardened with an electron beam. Specific examples of the base polymer include: thermosetting rubber materials obtained by compounding a cross-linking agent into raw material rubbers such as a natural rubber (NR), an isoprene rubber (IR), a butadiene rubber (BR), a styrene-butadiene rubber (SBR), a butyl rubber (isobutylene-isoprene rubber: IIR), an ethylene-propylene-diene terpolymer rubber (EPDM), an epichlorohydrin homopolymer (CHC), an epichlorohydrin-ethylene oxide copolymer (CHR), an epichlorohydrin-ethylene oxide-allyl glycidyl ether terpolymer (CHR-AGE), an acrylonitrile-butadiene copolymer (NBR), a hydrogenated acrylonitrile-butadiene copolymer (H-NBR), a chloroprene rubber (CR), or an acrylic rubber (ACM, ANM); and thermoplastic elastomers such as a polyolefin-based thermoplastic elastomer, a polystyrene-based thermoplastic elastomer, a polyester-based thermoplastic elastomer, a polyurethane-based thermoplastic elastomer, a polyamide-based thermoplastic elastomer, and a vinyl chloride-based thermoplastic elastomer.

The base polymer preferably contains a butadiene rubber (BR) or a styrene-butadiene rubber (SBR) in order to improve compatibility and covulcanization characteristic with a liquid rubber to be described later.

In the elastic layer, it is preferred to compound, as a compounding agent, a liquid rubber having a butadiene skeleton and containing per molecule three or more functional groups selected from an acrylic group, a methacryloyl group, and a maleic acid group. The liquid rubber preferably has a butadiene skeleton. When the liquid rubber has a butadiene skeleton, the number of unsaturated bonds in one molecule increases, resulting in satisfactory covulcanization characteristic with the base polymer. The liquid rubber has a low-molecular-weight rubber component. Hence, when the covulcanization characteristic of the liquid rubber with the base polymer is low, the liquid rubber may migrate to the surface of the charging member. Covulcanization with the base polymer is sufficiently carried out by compounding the liquid rubber having a butadiene skeleton. As a result, the liquid rubber can be prevented from migrating to the surface of the charging member. Thus, the occurrence of contamination of the photosensitive member can be prevented. The molecular weight of the liquid rubber falls within preferably a range of 1,000 to 30,000. The control of the molecular weight to 1,000 or more can sufficiently prevent the migration of the liquid rubber to the surface of the charging member. The control of the molecular weight to 30,000 or less can sufficiently reduce the hardness of the elastic layer.

It is preferred that the liquid rubber contain per molecule three or more functional groups selected from an acrylic group, a methacryloyl group, and a maleic acid group. Upon irradiation with an electron beam, those functional groups generate radicals, which cause a cross-linking reaction. Further, those functional groups have relatively satisfactory stability against heat, and thus no cross-linking reaction is initiated in a heating step in the molding and vulcanization of the elastic layer to be described later. With this, when the surface of the elastic layer is irradiated with an electron beam, the cross-linking density of the charging member can be increased only in its surface, and a difference in hardness between the surface and the inside of the charging member can be increased. In particular, the incorporation of three or more functional groups per molecule can sufficiently enhance the hardness in the surface of the charging member. The functional groups may each exist alone in one molecule. Alternatively, the three kinds of functional groups may coexist in one molecule.

It is preferred that the liquid rubber have satisfactory covulcanization characteristic with the base polymer. To this end, it is more preferred that the liquid rubber have satisfactory compatibility with the base polymer. The liquid rubber not only has a butadiene skeleton but also has the following functional groups: an acrylic group; a methacryloyl group; and a maleic acid group. Hence, the liquid rubber has polarity in the molecule. The base polymer preferably contains BR or SBR having high compatibility with the butadiene skeleton in the liquid rubber, and more preferably contains NBR as a polar rubber having an unsaturated bond in addition to the foregoing. The use of a blend of BR or SBR with NBR as the base polymer improves the compatibility of the liquid rubber with base polymer, and the liquid rubber acts like a compatibilizer of NBR as a polar rubber and BR or SBR as a non-polar rubber, resulting in satisfactory uniformity of the elastic layer.

The liquid rubber is preferably compounded in an amount of 5 parts by mass or more and 50 parts by mass or less with respect to 100 parts by mass of the base polymer. The control of the compounding amount to 5 parts by mass or more can reduce the hardness in the inside of the elastic layer and sufficiently increase the hardness in the surface of the elastic layer. Further, the control of the compounding amount to 50 parts by mass or less can prevent deterioration in processability due to an excessive decrease in viscosity of an unvulcanized rubber composition.

The elastic layer preferably has a volume resistivity adjusted to $1\times10^3$ to $1\times10^7$ Ω·cm. The control of the volume resistivity of the elastic layer to $1\times10^3$ Ω·cm or more can prevent leakage caused by pinholes, damage, and the like present in slight amounts in the surface of the photosensitive member. Further, the control of the volume resistivity to $1\times10^7$ Ω·cm or less can prevent the photosensitive member from being charged non-uniformly owing to a decrease in discharged charge amount.

A conductive agent is preferably added to the base polymer for the purpose of adjusting the electric resistance of the elastic layer. Examples of the conductive agent include: carbon materials such as carbon black and graphite; oxides such as titanium oxide and tin oxide; metals such as Cu and Ag; electron conductive agents such as conductive particles rendered conductive by coating particles surfaces with an oxide or a metal; inorganic ionic substances such as lithium perchlorate, sodium perchlorate, and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and a modified aliphatic dimethylethylammonium ethosulfate; zwitterionic surfactants such as lauryl betaine, stearyl betaine, and dimethylalkyllauryl betaine; quaternary ammonium salts such as tetraethylammonium perchlorate, tetrabutylammonium perchlorate, and trimethyloctadecylammonium perchlorate; and ion conductive agents such as organic acid lithium salts including lithium trifluoromethanesulfonate.

Of the conductive agents mentioned above, an electron conductive agent is preferably compounded in order to prevent the migration to the surface of the elastic layer.

A filler, a processing aid, an antioxidant, a cross-linking aid, a cross-linking accelerator, a cross-linking supplement accelerator, a cross-linking retarder, a dispersant, and the like, which are generally used as compounding agents for a rubber, may be added to the base polymer as required.

A mixing method for those materials may be exemplified by a mixing method using a closed mixer such as a Banbury mixer or a pressure kneader and a mixing method using an open mixer such as an open roll.

Unless otherwise stated, the elastic layer as used herein means an elastic layer as a surface layer of a charging member (sometimes referred to as surface elastic layer). In the present invention, an adhesion layer may also be formed between the support and the surface elastic layer. Further, the elastic layer may also be formed of a plurality of layers (have one or more elastic layers in addition to a surface elastic layer). In this regard, however, when the elastic layer is formed of a plurality of layers, it is preferred to form, on the outermost surface of the charging member, a layer (surface elastic layer) containing the liquid rubber having the functional groups described above. Further, when the elastic layer is formed of a plurality of layers, in a method involving extrusion into a tube shape or a method involving extrusion using a cross head to be described later, it is preferred to simultaneously form the respective layers through the use of a multilayer extruder. In the present invention, it is most preferred that the elastic layer be formed of a mono-layer (only the surface elastic layer) in order to maximize an effect of simplifying production steps.

<Manufacturing Method for Charging Member>

A manufacturing method for a charging member having a roller shape, i.e., a charging roller, according to the present invention is as described below. First, a rubber roller having formed on an electro-conductive support (mandrel) a rubber layer of a mono-layer obtained by the vulcanization of a layer formed of the unvulcanized rubber composition is molded. As a molding method for the rubber roller, as described above, there may be given, for example: a method involving extrusion-molding an unvulcanized rubber composition into a tube shape with an extruder and inserting a mandrel into the resultant; a method involving co-extruding an unvulcanized rubber composition into a cylindrical shape around the mandrel at the center with an extruder equipped with a cross head, to thereby obtain a molded article having a desired outer diameter; and a method involving injecting an unvulcanized rubber composition into a mold having a desired outer diameter through the use of an injection molding machine to obtain a molded article. Of those, an extrusion molding method using a cross head extruder is most preferred because the method is easily applied to continuous production, has a small number of steps, and is suitable for manufacture at low cost.

When the rubber material is a thermosetting rubber, vulcanization is carried out after molding. The vulcanization is carried out by a heating treatment, and as a heating apparatus, there may be given, for example, hot-air oven heating with a Geer oven, heating vulcanization with far-infrared radiation, and steam heating with a vulcanizer. Of those, hot-air oven heating, far-infrared heating, or the like is preferred because it allows continuous production.

After the molding, for the purpose of arranging the shape of the rubber roller, the surface of the elastic layer may also be ground. A grinding method for the surface of the rubber roller is exemplified by the following grinding modes: a traverse grinding mode involving grinding by shifting grindstone or a roller in a thrust direction of the roller; and a plunge cut grinding mode involving cutting without the reciprocation of grindstone wider than the length of the roller while allowing the roller to rotate around a mandrel shaft at the center. A plunge cut cylindrical grinding mode is more preferred because it has an advantage in that the whole width of the rubber roller can be ground at once, and can shorten a processing time as compared to a traverse cylindrical grinding mode.

Finally, a modification treatment for increasing the cross-linking density on the surface side of the rubber layer of a mono-layer is carried out. Specific examples thereof may include irradiation with an electron beam.

Figure 3:
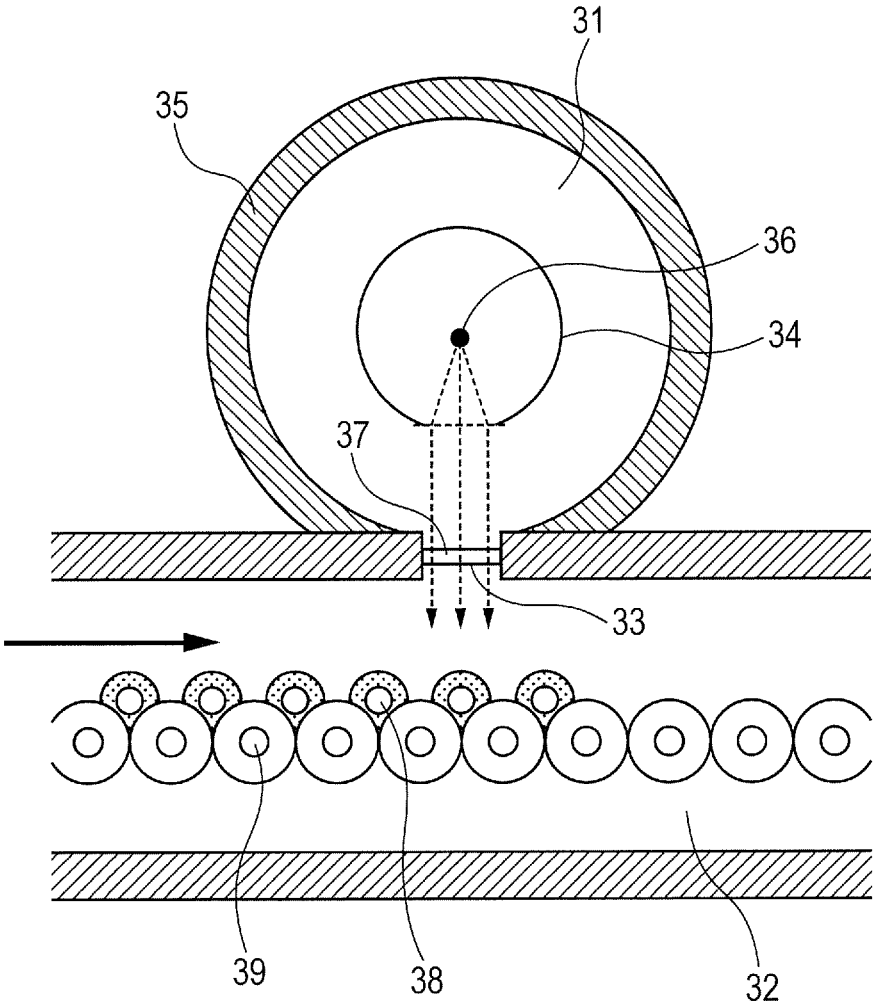
FIG. 3 is a diagram illustrating a schematic configuration example of an electron beam irradiation apparatus.

FIG. 3 illustrates a schematic diagram of an electron beam irradiation apparatus.

The electron beam irradiation apparatus which may be used in the present invention is an apparatus for irradiating the surface of the roller with an electron beam while allowing the rubber roller to rotate. As illustrated in FIG. 3, the apparatus includes an electron beam-generating portion 31, an irradiation chamber 32, and an irradiation hole 33.

The electron beam-generating portion 31 has a terminal 34 for generating an electron beam and an accelerating tube 35 for accelerating the electron beam generated in the terminal 34 in a vacuum space (accelerating space). Further, the inside of the electron beam-generating portion is kept at a vacuum of $10^{-6}$ Pa or more and $10^{-8}$ Pa or less with a vacuum pump (not shown) or the like in order to prevent an electron from colliding with a gas molecule to lose energy.

When a filament 36 is heated by being applied with a current by a power source (not shown), the filament 36 releases thermoelectrons, and only the thermoelectron that has passed through the terminal 34 is extracted effectively as an electron beam. Then, the electron beam is accelerated in the accelerating space of the accelerating tube 35 with an accelerating voltage of the electron beam. After that, the electron beam passes through an irradiation hole foil 37 to irradiate a vulcanized rubber roller 38 after grinding to be conveyed in the irradiation chamber 32 on the lower side of the irradiation hole 33.

When the rubber roller 38 is irradiated with the electron beam, the inside of the irradiation chamber 32 may be a nitrogen atmosphere. Further, the rubber roller 38 is allowed to rotate with a member for roller rotation 39 and moves from the left side to the right side in the irradiation chamber in FIG. 3 by conveying unit. It should be noted that the electron beam-generating portion 31 and the irradiation chamber 32 are surrounded by lead shielding (not shown) in order to prevent an X-ray to be generated secondarily upon irradiation with an electron beam from leaking to the outside.

The irradiation hole foil 37 is formed of a metal foil and separates a vacuum atmosphere in the electron beam-generating portion from an air atmosphere in the irradiation chamber. Further, an electron beam is extracted into the irradiation chamber via the irradiation hole foil 37. As mentioned above, when an electron beam is applied to the irradiation of the rubber roller, the inside of the irradiation chamber 32 in which the roller is irradiated with an electron beam may be a nitrogen atmosphere. Accordingly, the irradiation hole foil 37 to be provided at the boundary between the electron beam-generating portion 31 and the irradiation chamber 32 desirably has no pinhole, has a mechanical strength enough to maintain a vacuum atmosphere in the electron beam-generating portion, and allows an electron beam to pass therethrough easily. Therefore, the irradiation hole foil 37 is desirably a metal foil having a small specific gravity and a small thickness, and an aluminum or titanium foil is generally used.

A condition for a modification (hardening) treatment with an electron beam depends on the accelerating voltage and dose of the electron beam.

The penetration depth of the electron beam to an object to be irradiated may be controlled by adjusting the accelerating voltage of the electron beam. When the accelerating voltage is high, the penetration depth becomes large, and the hardening treatment depth of the elastic layer also becomes large. In the present invention, it is necessary to increase a difference in hardness between the inside and the surface of the charging member, and hardening with an electron beam is preferably carried out only in the vicinity of the surface.

Thus, the condition for the accelerating voltage to be used in the present invention is preferably 40 kV or more and 300 kV or less in a low-energy region. The control of the accelerating voltage to 40 kV or more can provide a hardening treatment depth enough to provide the effect of the present invention. Further, the control of the accelerating voltage to 300 kV or less can prevent an excessive increase in MD-1 hardness due to an excessively large modification depth. Further, an increase in apparatus cost due to upsizing of an electron beam irradiation apparatus can be particularly suppressed. A more preferred condition for the accelerating voltage is 70 kV or more and 150 kV or less.

The dose of the electron beam in the electron beam irradiation is defined by the following equation (2).

$$D=(K\cdot I)/V \tag{2}$$

In the equation, D represents a dose (kGy), K represents an apparatus constant, I represents an electron current (mA), and V represents a treatment speed (m/min). The apparatus constant K is a constant representing the efficiency of each apparatus and is an indicator of the performance of the apparatus. The apparatus constant K may be determined by measuring the dose while changing the electron current and the treatment speed under the condition of a constant accelerating voltage. The dose of the electron beam may be measured as described below. A film for dose measurement is attached to the surface of the roller, the resultant is actually treated with the electron beam irradiation apparatus, and the film for dose measurement on the surface of the roller is subjected to measurement with a film dosimeter. In this case, the film for dose measurement and the film dosimeter used may be FWT-60 and FWT-92D type (each of which is a trade name, manufactured by Far West Technology, Inc.), respectively.

The dose of the electron beam to be used in the present invention is preferably 300 kGy or more and 3,000 kGy or less. The control of the dose to 300 kGy or more can easily provide a surface hardness enough to provide the effect of the present invention. Further, the control of the dose to 3,000 kGy or less can particularly suppress an increase in manufacturing cost due to upsizing of an electron beam irradiation apparatus or an increase in treatment time.

EXAMPLES

Hereinafter, the present invention is described in more detail by way of examples. However, the present invention is by no means limited to these examples. It should be noted that, in the following, the term "part(s)" means "part(s) by mass" unless otherwise stated and a commercial high-purity product was used as a reagent or the like unless otherwise specified. It should be noted that a charging roller was produced in each of the examples and comparative examples.

Example 1

Preparation of Unvulcanized Rubber Composition for Elastic Layer

The following materials were mixed with a 6-L pressure kneader (trade name: TD6-15MDX, manufactured by TOHSHIN CO., LTD.) for 16 minutes at a filling factor of 70 vol % and a blade rotational frequency of 30 rpm. Thus, an A-kneading rubber composition was obtained.

- NBR as a raw material rubber (trade name: Nipol DN219, manufactured by ZEON CORPORATION): 60 parts by mass and SBR as a raw material rubber (JSR SL552, manufactured by JSR): 40 parts by mass
- Zinc stearate as a processing aid: 1 part by mass
- Zinc oxide as a vulcanization supplement accelerator: 5 parts by mass
- Calcium carbonate as a filler (trade name: Super #2300, manufactured by MARUO CALCIUM CO., LTD.): 30 parts by mass
- Carbon black-1 as a conductive agent (trade name: TOKABLACK #7270SB, manufactured by TOKAI CARBON CO., LTD.): 35 parts by mass
- Liquid rubber-1 as a liquid rubber (trade name: Ricacryl 3500, methacrylate-modified liquid butadiene rubber, the number of functional groups per molecule: 9, manufactured by SARTOMER): 20 parts by mass Next, the following materials were bilaterally cut a total of twenty times with an open roll having a roll diameter of 12 inches at a front roll rotational frequency of 8 rpm, a back roll rotational frequency of 10 rpm, and a roll interval of 2 mm, and then subjected to tight milling ten times at a roll interval of 0.5 mm. Thus, an unvulcanized rubber composition for an elastic layer was obtained.

- A-kneading rubber composition obtained in the foregoing: 191 parts by mass
- Sulfur as a cross-linking agent: 1.2 parts by mass
- N-t-Butyl-2-benzothiazolesulfenamide as a vulcanization accelerator (trade name: NOCCELER NS, manufactured by OUCHI SHINKO CHEMICAL INDUSTRIAL CO., LTD.): 1.0 parts by mass (Molding of Elastic Layer)

An electro-conductive vulcanizing adhesive (METALOC U-20, manufactured by Toyo Kagaku Kenkyusho Co., Ltd.) was applied to a central portion having a length of 226 mm in the axial direction of the cylindrical surface of a cylindrical electro-conductive mandrel (made of steel and having a nickel-plated surface) having a diameter of 6 mm and a length of 252 mm, and was then dried at 80° C. for 30 minutes. Next, the unvulcanized rubber composition was simultaneously extruded, by extrusion molding using a cross head, into a cylindrical shape in a coaxial fashion around the mandrel at the center, to thereby produce a unvulcanized rubber roller having a diameter of 8.8 mm and coated with the unvulcanized rubber composition on the outer circumference of the mandrel. An extruder having a cylinder diameter of 45 mm (Φ45) and an L/D of 20 was used as an extruder, and the temperatures of a head, a cylinder, and a screw were controlled to 90° C., 90° C., and 90° C., respectively, during the extrusion. Both ends of the unvulcanized rubber roller after molding were cut, and the width in an axial direction of an elastic layer portion was set to 228 mm. After that, the resultant was subjected to a heating treatment in an electric furnace at 160° C. for 40 minutes to obtain a vulcanized rubber roller. A surface of the resultant vulcanized rubber roller was ground with a grinder of a plunge cut grinding mode. Thus, a rubber roller including an elastic layer having a crown shape with an end portion diameter of 8.35 mm and a central portion diameter of 8.50 mm was obtained.

(Hardening Treatment of Surface Layer)

The surface of the resultant rubber roller was irradiated with an electron beam to obtain a charging roller. An electron beam irradiation apparatus having a maximum accelerating voltage of 150 kV and a maximum electron current of 40 mA (manufactured by IWASAKI ELECTRIC CO., LTD.) was used for the irradiation with an electron beam, and nitrogen gas was purged during the irradiation. Conditions for the treatment were as follows: accelerating voltage: 150 kV; electron current: 20 mA; treatment speed: 0.5 m/min; and oxygen concentration: 50 ppm. The apparatus constant of the electron beam irradiation apparatus at an accelerating voltage of 150 kV was 37.8, and the dose calculated from the equation (2) was 1,512 kGy.

(MD-1 Hardness Measurement)

After irradiation with an electron beam, the MD-1 hardness in the surface of the charging roller was measured. The measurement was carried out through the use of a micro durometer (MD-1 capa, manufactured by KOBUNSHI KEIKI CO., LTD., type A) in a "PEAK HOLD" mode under the environment of a temperature 23° C. and a relative humidity of 55% RH. The shape of an indenter is a columnar shape having a height of 0.50 mm and a diameter of 0.16 mm, and the size of a pressure foot is an outer diameter of 4.0 mm and an inner diameter of 1.5 mm.

More specifically, the charging roller is placed on a metallic plate and simply fixed so that the charging roller does not roll away by placing a metallic block, a measuring terminal is pressed exactly against the center of the charging member from a direction perpendicular to the metallic plate, and a value after 5 seconds is read out. This measurement is carried out for a total of nine sites in a circumferential direction of both end portions located 30 to 40 mm away from the rubber end portion of the charging roller and a central portion of the charging roller (three sites for each of the portions). An average value of the resultant measured values was defined as the MD-1 hardness of the elastic layer. As a result, the MD-1 hardness of the elastic layer was 68°.

(Universal Hardness Measurement)

The universal hardness of the charging roller was measured through the use of an ultra-micro hardness meter (trade name: H-100V, manufactured by Fischer). A quadrangular pyramid diamond indenter was used as an indenter. An indentation speed satisfies the condition of the following equation (3). In the equation, F represents a force (mN) and t represents a time (s).

$$dF/dt=1{,}000\text{mN}/240\text{s} \quad (3)$$

The hardness at an indentation depth of 5 μm was read out under the above-mentioned measurement conditions. As a result, the universal hardness was 6.0 N/mm$^2$.

(Endurance Image Evaluation)

The produced charging roller and an electrophotographic photosensitive member were integrated into a process cartridge supporting the roller and the member integrally. The process cartridge was integrated into an electrophotographic apparatus for longitudinally outputting A4 paper (trade name: Color LaserJet CP2025dn manufactured by Hewlett-Packard) to carry out endurance evaluation.

The evaluation was carried out under the environment of a temperature of 15° C. and a relative humidity of 10% RH. After the printing of 3,000 sheets at a printing density of 4%, an output halftone image was observed visually and judged based on the following criteria. It should be noted that the halftone image is an image obtained by drawing lines with a width of one dot at an interval of two dots in a direction perpendicular to a rotational direction of an electrophotographic photosensitive member.

A: None of image failure due to uneven dirt on a charging roller and an adhered matter of toner or an external additive to the charging roller is observed.

B: An uneven density of a charging roller pitch due to uneven dirt on a charging roller is slightly observed in a halftone image.

C: An uneven density of a charging roller pitch due to uneven dirt on a charging roller is clearly observed in a halftone image. Alternatively, an image failure of a charging roller pitch due to an adhered matter of toner or an external additive to a charging roller is observed in a halftone image. In this regard, however, no image failure is observed in a blank paper image.

D: An image failure of a charging roller pitch due to an adhered matter of toner or an external additive to a charging roller is observed in a blank paper image as well as a halftone image.

(Set Image Evaluation)

Further, a process cartridge having integrated thereinto a new charging roller different from the charging roller used in the endurance image evaluation was prepared. The process cartridge was left to stand under the environment of 40° C./95% RH for 30 days in a state in which the charging roller and a photosensitive member abut on each other. After left to stand, the process cartridge was left to stand under the environment of 25° C./50% RH for 48 hours and then integrated into an electrophotographic apparatus again. Then, image evaluation after leaving to stand under a harsh environment was carried out. For image output, 20 sheets of halftone images were output under the environment of 25° C./50% RH. In addition, the electrophotographic apparatus was left to stand under the environment for the image output for 24 hours. After that, images were output again. The evaluation criteria are as shown below.

A: No image failure is observed.

B: An extremely slight image failure occurred in a first image output. In this regard, however, the image failure completely disappeared after the output of 20 sheets of images.

C: A slight image failure occurred in a first image output. The image failure still did not completely disappear after the output of 20 sheets of images. However, the image failure completely disappeared after leaving to stand for 24 hours.

D: A clear image failure occurred in a first image output. The image failure did not completely disappear after leaving to stand for 24 hours.

(C Set Amount Measurement)

After the image output, the charging roller was taken out from the process cartridge, the radius of the charging roller from the center, i.e., an electro-conductive support of the charging roller was measured, and a difference in radius between a portion at which the amount of deformation is largest in abutting portions and a non-abutting portion was defined as a C set amount. The charging roller was allowed to rotate 1° by 1° with respect to a rotation axis at the center through the use of a fully automatic roller measurement apparatus (manufactured by Tokyo Opto-Electronics Co., Ltd.), and a 360° measurement was carried out. Measurement positions were a total of three sites including a central portion of the roller in a longitudinal direction and positions at 90 mm from the central portion toward directions of both end portions. The largest amount of deformation was defined as the C set amount of the charging roller.

Example 2

An unvulcanized rubber composition for an elastic layer was prepared to produce a rubber roller in the same manner as in Example 1 except that the compounding amount of the liquid rubber-1 used in the A-kneading rubber composition of Example 1 was changed to 30 parts by mass and the compounding amount of the A-kneading rubber composition was changed to 201 parts by mass. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Example 3

An unvulcanized rubber composition for an elastic layer was prepared to produce a rubber roller in the same manner as in Example 1 except that the compounding amount of the liquid rubber-1 used in the A-kneading rubber composition of Example 1 was changed to 10 parts by mass and the compounding amount of the A-kneading rubber composition was changed to 181 parts by mass. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Example 4

An unvulcanized rubber composition for an elastic layer was prepared to produce a rubber roller in the same manner as in Example 1 except that the liquid rubber-1 used in the A-kneading rubber composition of Example 1 was changed to 10 parts by mass of a liquid rubber-2 (trade name: Ricon 156MA17, maleic acid-modified liquid butadiene rubber, the number of functional groups per molecule: 3, manufactured by SARTOMER) and the compounding amount of the A-kneading rubber composition was changed to 181 parts by mass. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Example 5

An unvulcanized rubber composition for an elastic layer was prepared to produce a rubber roller in the same manner as in Example 1 except that the liquid rubber-1 used in the A-kneading rubber composition of Example 1 was changed to 10 parts by mass of a liquid rubber-3 (trade name: Ricon 131MA20, maleic acid-modified liquid butadiene rubber, the number of functional groups per molecule: 11, manufactured by SARTOMER) and the compounding amount of the A-kneading rubber composition was changed to 181 parts by mass. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Comparative Example 1

An unvulcanized rubber composition for an elastic layer was prepared to produce a rubber roller in the same manner as in Example 1 except that the liquid rubber-1 used in the A-kneading rubber composition of Example 1 was changed to 10 parts by mass of a liquid rubber-4 (trade name: Ricon 134, unmodified liquid butadiene rubber, manufactured by SARTOMER) and the compounding amount of the A-kneading rubber composition was changed to 181 parts by mass. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Comparative Example 2

An unvulcanized rubber composition for an elastic layer was prepared to produce a rubber roller in the same manner as in Example 1 except that the liquid rubber-1 used in the A-kneading rubber composition of Example 1 was changed to 10 parts by mass of a liquid rubber-5 (trade name: Ricacryl 3100, methacrylate-modified liquid butadiene rubber, the number of functional groups per molecule: 2, manufactured by SARTOMER) and the compounding amount of the A-kneading rubber composition was changed to 181 parts by mass. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Comparative Example 3

An unvulcanized rubber composition for an elastic layer was prepared to produce a rubber roller in the same manner as in Example 1 except that the liquid rubber-1 was not compounded in the A-kneading rubber composition of Example 1 and the compounding amount of the A-kneading rubber composition was changed to 171 parts by mass. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Comparative Example 4

An unvulcanized rubber composition for an elastic layer was prepared to produce a rubber roller in the same manner as in Example 1 except that the liquid rubber-1 used in the A-kneading rubber composition of Example 1 was changed to the liquid rubber-4. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Comparative Example 5

An unvulcanized rubber composition for an elastic layer was prepared to produce a rubber roller in the same manner as in Example 1 except that the liquid rubber-1 used in the A-kneading rubber composition of Example 1 was changed to the liquid rubber-5. A charging roller was produced by irradiation with an electron beam under the same conditions as those in Example 1. In the same manner as in Example 1, the resultant charging roller was subjected to MD-1 hardness measurement, universal hardness measurement, endurance image evaluation, and set image evaluation.

Example 6

A charging roller was produced in the same manner as in Example 1 except that one of the conditions for the irradiation with an electron beam in Example 1 was changed as follows: electron current: 10 mA. In this example, the dose calculated from the equation (2) was 756 kGy. In the same manner as in Example 1, the resultant charging roller was subjected to MD-1 hardness measurement, universal hardness measurement, endurance image evaluation, and set image evaluation.

Example 7

A charging roller was produced in the same manner as in Example 1 except that one of the conditions for the irradiation with an electron beam in Example 1 was changed as follows: electron current: 35 mA. In this example, the dose calculated from the equation (2) was 2,646 kGy. In the same manner as in Example 1, the resultant charging roller was subjected to MD-1 hardness measurement, universal hardness measurement, endurance image evaluation, and set image evaluation.

Example 8

A charging roller was produced in the same manner as in Example 7 except that one of the conditions for the irradiation with an electron beam of Example 7 was changed as follows: accelerating voltage: 80 kV. In this example, the apparatus constant of the electron beam irradiation apparatus at an accelerating voltage of 80 kV was 20.4, and the dose calculated from the equation (2) was 1,428 kGy. In the same manner as in Example 1, the resultant charging roller was subjected to MD-1 hardness measurement, universal hardness measurement, endurance image evaluation, and set image evaluation.

Example 9

A charging roller was produced in the same manner as in Example 7 except that one of the conditions for the irradiation with an electron beam of Example 7 was changed as follows: accelerating voltage: 120 kV. In this example, the apparatus constant of the electron beam irradiation apparatus at an accelerating voltage of 120 kV was 30.3, and the dose calculated from the equation (2) was 2,121 kGy. In the same manner as in Example 1, the resultant charging roller was subjected to MD-1 hardness measurement, universal hardness measurement, endurance image evaluation, and set image evaluation.

Example 10

A charging roller was produced in the same manner as in Example 1 except that one of the conditions for the irradiation with an electron beam in Example 9 was changed as follows: electron current: 10 mA. In this example, the dose calculated from the equation (2) was 606 kGy. In the same manner as in Example 1, the resultant charging roller was subjected to MD-1 hardness measurement, universal hardness measurement, endurance image evaluation, and set image evaluation.

Example 11

An unvulcanized rubber composition was prepared to produce a rubber roller in the same manner as in Example 3 except that, in the preparation of the unvulcanized rubber composition for an elastic layer of Example 3, the following materials were used:

NBR as a raw material rubber: 80 parts by mass; SBR as a raw material rubber: 20 parts by mass Calcium carbonate as a filler: 20 parts by mass Carbon black-1 as a conductive agent: 55 parts by mass; carbon black-2 (trade name: Thermax Floform N990, manufactured by CANCAB) as a conductive agent: 10 parts by mass Sulfur as a cross-linking agent: 1.5 parts by mass, and the compounding amount of the A-kneading rubber composition was changed to 201 parts by mass. A charging roller was produced by irradiation with an electron beam under the same conditions as in Example 8. In the same manner as in Example 1, the resultant charging roller was subjected to MD-1 hardness measurement, universal hardness measurement, endurance image evaluation, and set image evaluation.

Comparative Example 6

An unvulcanized rubber composition for an elastic layer was prepared to produce a rubber roller in the same manner as in Example 11 except that the liquid rubber-1 was not compounded in the A-kneading rubber composition of Example 11 and the compounding amount of the A-kneading rubber composition was changed to 191 parts by mass. A charging roller was produced by irradiation with an electron beam under the same conditions as those in Example 11. In the same manner as in Example 1, the resultant charging roller was subjected to MD-1 hardness measurement, universal hardness measurement, endurance image evaluation, and set image evaluation.

Comparative Example 7

A charging roller was produced in the same manner as in Comparative Example 6 except that the conditions for the irradiation with an electron beam in Comparative Example 6 were changed as follows: electron current: 10 mA; and treatment speed: 1.0 m/min. In this comparative example, the dose calculated from the equation (2) was 204 kGy. In the same manner as in Example 1, the resultant charging roller was subjected to MD-1 hardness measurement, universal hardness measurement, endurance image evaluation, and set image evaluation.

Comparative Example 8

An unvulcanized rubber composition was prepared to produce a rubber roller in the same manner as in Comparative Example 4 except that, in the preparation of the unvulcanized rubber composition for an elastic layer of Comparative Example 4, the following materials were used:

Calcium carbonate as a filler: uncompounded

Carbon black-1: 30 parts by mass

Sulfur as a cross-linking agent: 0.5 part by mass, and the compounding amount of the A-kneading rubber composition was changed to 156 parts by mass. A charging roller was produced in the same manner as in Comparative Example 4 except that the conditions for the irradiation with an electron beam in Comparative Example 4 were changed as follows: electron current: 35 mA; and treatment speed: 0.3 m/min. The dose calculated from the equation (2) in this comparative example was 4,410 kGy. In the same manner as in Example 1, the resultant charging roller was subjected to MD-1 hardness measurement, universal hardness measurement, endurance image evaluation, and set image evaluation.

Example 12

A charging roller was produced in the same manner as in Example 7 except that, in the preparation of the unvulcanized rubber composition for an elastic layer of Example 7, the following materials were used:

Calcium carbonate as a filler: uncompounded

Carbon black-1: 30 parts by mass

Sulfur as a cross-linking agent: 0.5 part by mass, and the compounding amount of the A-kneading rubber composition was changed to 156 parts by mass. In the same manner as in Example 7, the resultant charging roller was subjected to MD-1 hardness measurement, universal hardness measurement, endurance image evaluation, and set image evaluation.

Example 13

An unvulcanized rubber composition was prepared to produce a rubber roller in the same manner as in Example 12 except that, in the preparation of the unvulcanized rubber composition for an elastic layer of Example 12, the following materials were used:

Liquid rubber-1: 10 parts by mass

Sulfur as a cross-linking agent: 1.0 part by mass, and the compounding amount of the A-kneading rubber composition was changed to 146 parts by mass. A charging roller was produced in the same manner as in Example 12 except that the conditions for the irradiation with an electron beam in Example 12 were changed as follows: accelerating voltage: 80 kV; and electron current: 20 mA. The dose calculated from the equation (2) in this example was 816 kGy. In the same manner as in Example 1, the resultant charging roller was subjected to MD-1 hardness measurement, universal hardness measurement, endurance image evaluation, and set image evaluation.

Comparative Example 9

A charging roller was produced in the same manner as in Example 13 except that the liquid rubber-1 used in the A-kneading rubber composition of Example 13 was changed to the liquid rubber-4. In the same manner as in Example 1, the resultant charging roller was subjected to MD-1 hardness measurement, universal hardness measurement, endurance image evaluation, and set image evaluation.

Comparative Example 10

A charging roller was produced in the same manner as in Comparative Example 8 except that one of the conditions for the irradiation with an electron beam in Comparative Example 8 was changed as follows: treatment speed: 0.2 m/min. The dose calculated from the equation (2) in this comparative example was 6,615 kGy. In the same manner as in Example 1, the resultant charging roller was subjected to MD-1 hardness measurement, universal hardness measurement, endurance image evaluation, and set image evaluation.

Comparative Example 11

A charging roller was produced in the same manner as in Comparative Example 2 except that the conditions for the irradiation with an electron beam in Comparative Example 2 were changed as follows: electron current: 35 mA; and treatment speed: 0.3 m/min. The dose calculated from the equation (2) in this comparative example was 4,410 kGy. In the same manner as in Example 1, the resultant charging roller was subjected to MD-1 hardness measurement, universal hardness measurement, endurance image evaluation, and set image evaluation.

Comparative Example 12

A charging roller was produced in the same manner as in Comparative Example 3 except that the conditions for the irradiation with an electron beam in Comparative Example 3 were changed as follows: electron current: 35 mA; and treatment speed: 0.3 m/min. The dose calculated from the equation (2) in this comparative example was 4,410 kGy. In the same manner as in Example 1, the resultant charging roller was subjected to MD-1 hardness measurement, universal hardness measurement, endurance image evaluation, and set image evaluation.

Example 14

A charging roller was produced in the same manner as in Example 1 except that SBR as a raw material rubber used in the A-kneading rubber composition of Example 1 was changed to BR (trade name: UBEPOL VCR-412, manufactured by Ube Industries, Ltd.). In the same manner as in Example 1, the resultant charging roller was subjected to MD-1 hardness measurement, universal hardness measurement, endurance image evaluation, and set image evaluation.

Example 15

A charging roller was produced in the same manner as in Example 3 except that, in the preparation of the unvulcanized rubber composition for an elastic layer of Example 3, the following materials were used:

BR as a raw material rubber: 100 parts by mass

Carbon black-1 as a conductive agent: 50 parts by mass, and the compounding amount of the A-kneading rubber composition was changed to 196 parts by mass. In the same manner as in Example 1, the resultant charging roller was subjected to MD-1 hardness measurement, universal hardness measurement, endurance image evaluation, and set image evaluation.

Table 1 shows modification groups and the number of functional groups per molecule in the liquid rubber-1 to the liquid rubber-5 used in Examples and Comparative Examples above.

Further, Table 2-1, Table 3-1, and Table 4-1 show raw material compositions of the elastic layers and conditions for irradiation of the surfaces of the elastic layers with an electron beam in the charging rollers according to Examples and Comparative Examples. Table 2-2, Table 3-2, and Table 4-2 show the MD-1 hardness (°), universal hardness (N/mm$^2$), C set amount (μm), and image evaluation results of the elastic layers of the charging rollers according to Examples and Comparative Examples.

TABLE 1

| Liquid rubber No. | Modification group | Number of functional groups per molecule |
|---|---|---|
| Liquid rubber-1 | Methacrylate | 9 |
| Liquid rubber-2 | Maleic acid | 3 |
| Liquid rubber-3 | Maleic acid | 11 |
| Liquid rubber-4 | Unmodified | — |
| Liquid rubber-5 | Methacrylate | 2 |

TABLE 2-1

| | | Example | | | | | Comparative Example | | | |
|---|---|---|---|---|---|---|---|---|---|---|
| | | 1 | 2 | 3 | 4 | 5 | 1 | 2 | 3 | 4 |
| Compounding amount (part(s) by mass) | NBR | 60 | 60 | 60 | 60 | 60 | 60 | 60 | 60 | 60 |
| | SBR | 40 | 40 | 40 | 40 | 40 | 40 | 40 | 40 | 40 |
| | BR | — | — | — | — | — | — | — | — | — |
| | Zinc stearate | 1 | 1 | 1 | 1 | 1 | 1 | 1 | 1 | 1 |
| | Zinc oxide | 5 | 5 | 5 | 5 | 5 | 5 | 5 | 5 | 5 |
| | Calcium carbonate | 30 | 30 | 30 | 30 | 30 | 30 | 30 | 30 | 30 |
| | Carbon black-1 | 35 | 35 | 35 | 35 | 35 | 35 | 35 | 35 | 35 |
| | Carbon black-2 | — | — | — | — | — | — | — | — | — |
| | Liquid rubber-1 | 20 | 30 | 10 | — | — | — | — | — | — |
| | Liquid rubber-2 | — | — | — | 10 | — | — | — | — | — |

TABLE 2-1-continued

| | | Example | | | | | Comparative Example | | | |
|---|---|---|---|---|---|---|---|---|---|---|
| | | 1 | 2 | 3 | 4 | 5 | 1 | 2 | 3 | 4 |
| | Liquid rubber-3 | — | — | — | — | 10 | — | — | — | — |
| | Liquid rubber-4 | — | — | — | — | — | 10 | — | — | 20 |
| | Liquid rubber-5 | — | — | — | — | — | — | 10 | — | — |
| | A-kneading rubber composition | 191 | 201 | 181 | 181 | 181 | 181 | 181 | 171 | 191 |
| | Sulfur | 1.2 | 1.2 | 1.2 | 1.2 | 1.2 | 1.2 | 1.2 | 1.2 | 1.2 |
| | Vulcanization accelerator | 1 | 1 | 1 | 1 | 1 | 1 | 1 | 1 | 1 |
| Conditions for irradiation with electron beam | Accelerating voltage (kV) | 150 | 150 | 150 | 150 | 150 | 150 | 150 | 150 | 150 |
| | Current (mA) | 20 | 20 | 20 | 20 | 20 | 20 | 20 | 20 | 20 |
| | Treatment speed (m/min) | 0.5 | 0.5 | 0.5 | 0.5 | 0.5 | 0.5 | 0.5 | 0.5 | 0.5 |
| | Dose (kGy) | 1,512 | 1,512 | 1,512 | 1,512 | 1,512 | 1,512 | 1,512 | 1,512 | 1,512 |

TABLE 2-2

| | | Example | | | | | Comparative Example | | | |
|---|---|---|---|---|---|---|---|---|---|---|
| | | 1 | 2 | 3 | 4 | 5 | 1 | 2 | 3 | 4 |
| MD-1 hardness (°) | | 68 | 65 | 70 | 71 | 71 | 67 | 66 | 72 | 60 |
| Universal hardness ($N/mm^2$) | | 6.0 | 10.2 | 3.5 | 3.0 | 3.8 | 1.4 | 1.1 | 1.6 | 1.0 |
| C set amount (μm) | | 10 | 8 | 13 | 13 | 12 | 20 | 21 | 15 | 20 |
| Image evaluation rank | Endurance image | A | A | A | A | A | A | A | B | A |
| | Set image | A | A | B | B | B | D | D | C | D |

TABLE 3-1

| | | Example | | | | | | Comparative Example | | |
|---|---|---|---|---|---|---|---|---|---|---|
| | | 6 | 7 | 8 | 9 | 10 | 11 | 5 | 6 | 7 |
| Compounding amount (part(s) by mass) | NBR | 60 | 60 | 60 | 60 | 60 | 80 | 60 | 80 | 80 |
| | SBR | 40 | 40 | 40 | 40 | 40 | 20 | 40 | 20 | 20 |
| | BR | — | — | — | — | — | — | — | — | — |
| | Zinc stearate | 1 | 1 | 1 | 1 | 1 | 1 | 1 | 1 | 1 |
| | Zinc oxide | 5 | 5 | 5 | 5 | 5 | 5 | 5 | 5 | 5 |
| | Calcium carbonate | 30 | 30 | 30 | 30 | 30 | 20 | 30 | 20 | 20 |
| | Carbon black-1 | 35 | 35 | 35 | 35 | 35 | 55 | 35 | 55 | 55 |
| | Carbon black-2 | — | — | — | — | — | 10 | — | 10 | 10 |
| | Liquid rubber-1 | 20 | 20 | 20 | 20 | 20 | 10 | — | — | — |
| | Liquid rubber-2 | — | — | — | — | — | — | — | — | — |
| | Liquid rubber-3 | — | — | — | — | — | — | — | — | — |
| | Liquid rubber-4 | — | — | — | — | — | — | — | — | — |
| | Liquid rubber-5 | — | — | — | — | — | — | 20 | — | — |
| | A-kneading rubber composition | 191 | 191 | 191 | 191 | 191 | 201 | 191 | 191 | 191 |
| | Sulfur | 1.2 | 1.2 | 1.2 | 1.2 | 1.2 | 1.5 | 1.2 | 1.5 | 1.5 |
| | Vulcanization accelerator | 1 | 1 | 1 | 1 | 1 | 1 | 1 | 1 | 1 |
| Conditions for irradiation with electron beam | Accelerating voltage (kV) | 150 | 150 | 80 | 120 | 120 | 80 | 150 | 80 | 80 |
| | Current (mA) | 10 | 35 | 35 | 35 | 10 | 35 | 20 | 35 | 10 |
| | Treatment speed (m/min) | 0.5 | 0.5 | 0.5 | 0.5 | 0.5 | 0.5 | 0.5 | 0.5 | 1 |
| | Dose (kGy) | 756 | 2,646 | 1,428 | 2,121 | 606 | 1,428 | 1,512 | 1,428 | 204 |

TABLE 3-2

| | | Example | | | | | | Comparative Example | | |
|---|---|---|---|---|---|---|---|---|---|---|
| | | 6 | 7 | 8 | 9 | 10 | 11 | 5 | 6 | 7 |
| MD-1 hardness (°) | | 65 | 84 | 56 | 73 | 65 | 84 | 57 | 86 | 83 |
| Universal hardness (N/mm$^2$) | | 3.0 | 19.8 | 2.1 | 12.6 | 3.0 | 4.0 | 0.8 | 3.5 | 1.8 |
| C set amount (μm) | | 17 | 8 | 18 | 8 | 16 | 13 | 23 | 12 | 13 |
| Image evaluation rank | Endurance image | A | B | A | B | A | B | A | C | B |
| | Set image | B | A | B | A | B | A | D | A | C |

TABLE 4-1

| | | Example | | | | Comparative Example | | | | |
|---|---|---|---|---|---|---|---|---|---|---|
| | | 12 | 13 | 14 | 15 | 8 | 9 | 10 | 11 | 12 |
| Compounding amount (part(s) by mass) | NBR | 60 | 60 | 60 | — | 60 | 60 | 60 | 60 | 60 |
| | SBR | 40 | 40 | — | — | 40 | 40 | 40 | 40 | 40 |
| | BR | — | — | 40 | 100 | — | — | — | — | — |
| | Zinc stearate | 1 | 1 | 1 | 1 | 1 | 1 | 1 | 1 | 1 |
| | Zinc oxide | 5 | 5 | 5 | 5 | 5 | 5 | 5 | 5 | 5 |
| | Calcium carbonate | — | — | 30 | 30 | — | — | — | 30 | 30 |
| | Carbon black-1 | 30 | 30 | 35 | 50 | 30 | 30 | 30 | 35 | 35 |
| | Carbon black-2 | — | — | — | — | — | — | — | — | — |
| | Liquid rubber-1 | 20 | 10 | 20 | 10 | — | — | — | — | — |
| | Liquid rubber-2 | — | — | — | — | — | — | — | — | — |
| | Liquid rubber-3 | — | — | — | — | — | — | — | — | — |
| | Liquid rubber-4 | — | — | — | — | 20 | 10 | 20 | — | — |
| | Liquid rubber-5 | — | — | — | — | — | — | — | 10 | — |
| | A-kneading rubber composition | 156 | 146 | 191 | 196 | 156 | 146 | 156 | 181 | 171 |
| | Sulfur | 0.5 | 1 | 1.2 | 1.2 | 0.5 | 1 | 0.5 | 1.2 | 1.2 |
| | Vulcanization accelerator | 1 | 1 | 1 | 1 | 1 | 1 | 1 | 1 | 1 |
| Conditions for irradiation with electron beam | Accelerating voltage (kV) | 150 | 80 | 150 | 150 | 150 | 80 | 150 | 150 | 150 |
| | Current (mA) | 35 | 20 | 20 | 20 | 35 | 20 | 35 | 35 | 35 |
| | Treatment speed (m/min) | 0.5 | 0.5 | 0.5 | 0.5 | 0.3 | 0.5 | 0.2 | 0.3 | 0.3 |
| | Dose (kGy) | 2,646 | 816 | 1,512 | 1,512 | 4,410 | 816 | 6,615 | 4,410 | 4,410 |

TABLE 4-2

| | | Example | | | | Comparative Example | | | | |
|---|---|---|---|---|---|---|---|---|---|---|
| | | 12 | 13 | 14 | 15 | 8 | 9 | 10 | 11 | 12 |
| MD-1 hardness (°) | | 56 | 56 | 70 | 72 | 54 | 54 | 58 | 83 | 86 |
| Universal hardness (N/mm$^2$) | | 18.2 | 2.2 | 7.2 | 6.9 | 17.1 | 1.8 | 20.6 | 20.6 | 18.9 |
| C set amount (μm) | | 13 | 19 | 8 | 9 | 18 | 25 | 11 | 7 | 7 |
| Image evaluation rank | Endurance image | B | A | A | B | A | A | C | D | D |
| | Set image | B | B | A | B | C | D | B | A | A |

As shown in Table 2-2, Table 3-2, and Table 4-2, Comparative Example 3, in which no liquid rubber is compounded, is ranked "C" in the set image evaluation because a value for the universal hardness after irradiation with an electron beam is less than 2.0, indicating that the surface hardness is low.

Comparative Example 1 and Comparative Example 4, in which the compounded liquid rubber has no functional group that reacts on irradiation with an electron beam, are ranked "D" in the set image evaluation because a value for the universal hardness after irradiation with an electron beam is less than 2.0, indicating that the surface hardness is low. Comparative Example 2 and Comparative Example 5, in which the number of functional groups in the liquid rubber is less than 3, are also ranked "D" in the set image evaluation because a value for the universal hardness after irradiation with an electron beam is less than 2.0, indicating that the surface hardness is low.

Comparative Example 6 and Comparative Example 12 are ranked "C" or lower in the endurance image evaluation because a value for the MD-1 hardness is more than 85, indicating that the hardness of the elastic layer is high. Comparative Example 7 and Comparative Example 9 are ranked "C" or lower in the set image evaluation because a value for the universal hardness is less than 2.0, indicating that the surface hardness is low. Comparative Example 8 is ranked "C" in the set image evaluation because a value for the MD-1 hardness is less than 55, indicating that the hardness of the elastic layer is low and the amount of deformation is large. Comparative Example 10 and Comparative Example 11 are ranked "C" or lower in the endurance image evaluation because a value for the universal hardness is more than 20.0, indicating that the surface hardness is too high.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2011-150160 filed on Jul. 6, 2011, which is hereby incorporated by reference herein.

REFERENCE SIGNS LIST

10 charging roller
11 mandrel
12 elastic layer
21 electrophotographic photosensitive member
21*a* photosensitive layer
21*b* support
21*c* shaft
23 power source
23*a* rubbing power source
24 exposing unit
25 developing unit
26 transferring unit
27 transfer material
28 pre-exposing unit
29 cleaning unit
31 electron beam-generating portion
32 irradiation chamber
33 irradiation hole
34 terminal
35 accelerating tube
36 filament
37 irradiation hole foil
38 rubber roller
39 member for roller rotation

What is claimed is:

1. A charging member, comprising:
a support; and
an elastic layer,
wherein the elastic layer has an MD-1 hardness of from 55 to 85° at the surface thereof, and has a universal hardness of 2.0 to 20.0 N/mm$^2$ at an indentation depth of 5 μm from the surface thereof.

2. The charging member according to claim 1, wherein the elastic layer has an MD-1 hardness of from 65 to 75° at the surface thereof, and has a universal hardness of from 5.0 to 15.0 N/mm$^2$ at an indentation depth of 5 μm from the surface thereof.

3. The charging member according to claim 1, wherein the elastic layer is a mono-layer.

4. The charging member according to claim 1, wherein the elastic layer is formed by irradiating a surface of a rubber layer with an electron beam, said rubber layer being a mono-layer.

5. The charging member according to claim 4, wherein the elastic layer is formed by
vulcanizing and molding an unvulcanized rubber composition comprising the following rubbers (A) and (B), and then irradiating a surface of a vulcanized and molded product with an electron beam:
(A) a butadiene rubber or a styrene-butadiene rubber; and
(B) a liquid rubber having a butadiene skeleton and containing per molecule three or more functional groups seleced from an acrylic group, a methacryloyl group, and a maleic acid group.

6. An electrophotographic apparatus, comprising:
the charging member according to claim 1; and
an electrophotographic photosensitive member placed to be charged by the charging member.

7. A charging member, comprising:
a support; and
an elastic layer,
wherein the elastic layer is formed by vulcanizing and molding an unvulcanized rubber composition comprising the following rubbers (A) and (B), and then irradiating a surface of a vulcanized and molded product with an electron beam:
(A) a butadiene rubber or a styrene-butadiene rubber; and
(B) a liquid rubber having a butadiene skeleton and containing per molecule three or more functional groups selected from an acrylic group, a methacryloyl group, and a maleic acid group.

8. A manufacturing method for a charging member comprising a support and an elastic layer,
wherein the elastic layer has an MD-1 hardness of from 55 to 85° at the surface thereof, and has a universal hardness of 2.0 to 20.0 N/mm$^2$ at an indentation depth of 5 μm from the surface thereof, said elastic layer being a mono-layer,
the method comprising the steps of:
(1) forming, on the support, a rubber layer by vulcanizing a layer of an unvulcanized rubber composition comprising the following rubbers (A) and (B); and
(2) irradiating a surface of the rubber layer resulting from the step (1) with an electron beam:
(A) a butadiene rubber or a styrene-butadiene rubber; and
(B) a liquid rubber having a butadiene skeleton and containing per molecule three or more functional groups selected from an acrylic group, a methacryloyl group, and a maleic acid group.

9. The manufacturing method for the charging member according to claim 8, wherein an accelerating voltage of the electron beam is 40 kV or more and 300 kV or less.

10. The manufacturing method for the charging member according to claim 9, wherein the accelerating voltage of the electron beam is 70 kV or more and 150 kV or less.

11. The manufacturing method for the charging member according to claim 8, wherein a dose of the electron beam is 300 kGy or more and 3,000 kGy or less.

* * * * *

UNITED STATES PATENT AND TRADEMARK OFFICE

CERTIFICATE OF CORRECTION

PATENT NO. : 8,923,732 B2
APPLICATION NO. : 13/695781
DATED : December 30, 2014
INVENTOR(S) : Harada et al.

It is certified that error appears in the above-identified patent and that said Letters Patent is hereby corrected as shown below:

ON THE TITLE PAGE:

At item (22), change "PCT Filed: Jul. 2, 2012" to --Filed: Nov. 1, 2012--.

Please delete the following:
"(86) PCT No.: PCT/JP2012/004275
§ 371 (c)(1),
(2), (4) Date: Nov. 1, 2012".

Please delete the following:
"(87) PCT Pub. No.: WO2013/005411
PCT Pub. Date: Jan. 10, 2013".

Please insert the following:
--Related U.S. Application Data
(63) Continuation of application No. PCT/JP2012/004275,
filed on Jul. 2, 2012.--.

Signed and Sealed this
Twenty-fourth Day of November, 2015

Michelle K. Lee

Michelle K. Lee
*Director of the United States Patent and Trademark Office*